United States Patent [19]

Ono et al.

[11] Patent Number: 4,720,057

[45] Date of Patent: Jan. 19, 1988

[54] PRESS BOBBIN FOR YARN TREATMENT

[75] Inventors: Nobutaka Ono, Ashiya; Yasuhisa Seko, Toyonaka, both of Japan

[73] Assignee: Osaka Bobbin Kabushiki Kaisha, Osaka, Japan

[21] Appl. No.: 50,797

[22] Filed: May 15, 1987

[30] Foreign Application Priority Data

Dec. 15, 1986 [JP] Japan ..... 61-193575[U]

[51] Int. Cl.[4] ..... B65H 75/20

[52] U.S. Cl. ..... 242/118.11

[58] Field of Search ..... 242/118.11, 118.1, 118.2, 242/118; 68/189, 198

[56] References Cited

U.S. PATENT DOCUMENTS

| | | | |
|---|---|---|---|
| 3,471,102 | 10/1969 | Inouye et al. | 242/118.11 |
| 3,827,652 | 8/1974 | Burchette, Jr. | 242/118.11 |
| 4,108,396 | 8/1978 | Engel | 242/118.11 |
| 4,270,710 | 6/1981 | Ono | 242/118.11 |
| 4,454,734 | 6/1984 | Marquis et al. | 242/118.11 X |

FOREIGN PATENT DOCUMENTS

| | | | |
|---|---|---|---|
| 2631793 | 1/1978 | Fed. Rep. of Germany | 242/118.11 |

*Primary Examiner*—Stanley N. Gilreath

*Attorney, Agent, or Firm*—Flynn, Thiel, Boutell & Tanis

[57] ABSTRACT

A press bobbin for yarn treatment formed of a cylindrical wall which is fabricated by blow molding of a synthetic plastic and comprises relatively thin-gage zones and relatively thick-gage zones extending circumferentially and alternately arranged in the axial direction of the bobbin. The cylindrical wall defines an indentation configuration along the axial direction wherein the thin-gage zones correspond to projecting portions and the thick-gage zones to recessed portions. The thick-gage zones are defined with holes for passage of liquid and the thin-gage zones are, when pressed axially, bendable in a U-form to protrude outwardly, thereby to be axially compressible. The relatively thick-gage zones may be provided with reinforcing members which serve to suppress compression of the bobbin.

3 Claims, 17 Drawing Figures

PRESS BOBBIN FOR YARN TREATMENT

BACKGROUND OF THE INVENTION

1. Field of the Invention

This invention relates to a bobbin mainly for use in dyeing, thermal treatment, etc. of synthetic fiber yarns, and more particularly, to a press bobbin for yarn treatment which is fabricated by blow molding and, when compressed, does not cause biting of yarns into the bobbin, whereby occurrence of uneven yarns is avoided.

2. Related Art Statement

It is prevailing to use bobbins which are axially compressible in dyeing synthetic fiber yarns. Many press bobbins have been proposed, for example, in Japanese U.M. Publication No. 55-54692(1980), Japanese U.M. Publication No. 56-55172(1981), etc.

Heretofore, press bobbins of the foregoing type have been manufactured by injection molding, according to which cylindrical wall of a bobbin can be shaped freely in various forms, wherein in order to permit compression, as described above, wall portions having different contraction abilities are arranged in the axial direction or the axial frame is shaped in various bend forms, e.g. a corrugated or crenellated form by the use of molds having configurations conforming to such forms.

The injection molding technique, however, requires an intricate fabrication of a mold for that purpose. Particularly, it is very disadvantageous in economical aspect that every time when ring frames and longitudinal frames constituting a cylindrical wall of outer periphery of a bobbin are changed in their forms to other variants, different molds conforming to such configurations are fabricated.

It has also been attempted to mold the cylindrical wall of a bobbin by blow molding method instead of injection molding.

The accompanying FIG. 6 illustrates a typical example of a blow-molded press bobbin which is molded and fabricated by cramping a parison formed by extrusion molding between molds of a required configuration, blowing air into the parison to dilate it while causing it to cling tightly to the cavity faces. This bobbin is constructed so that the cylindrical wall (1) of the bobbin constitutes indentations in the axial direction thereof and each outwardly projecting portion (2) is defined with passage holes (3) for liquid flow. However, such bobbin thus constructed flexes, when compressed, in the portions having the passage holes to obstruct them and consequently, uniform passage of liquid is impeded, which is responsible for uneven dyeing.

On the other hand, a major problem with press bobbin when yarn treatment is effected with use of it is that bend portions of the press bobbin when compressed protrude inwardly and inner yarn portions of the yarn package bite into the bobbin being pressed with the result that non-uniform dyeing is caused.

According to conventional injection molding method, since wall thickness of a bobbin can be chosen freely, press bobbins have been manufactured in such a wall thickness that bending or flexing can be effected suitably, but most of them were of a kind that bend portions protrude inwardly. Accordingly, those existing bobbins produced by injection molding were not suitable for the purpose of preventing inner yarn portions of the yarn package from meshing with or biting into them, either.

In order to cope with the circumstances stated above, this invention is designed to provide a press bobbin which is fabricated by blow molding method and shaped so that uniform passage of liquid through it may be ensured and biting of inner yarn layers of a yarn package on the bobbin into it may be avoided.

SUMMARY OF THE INVENTION

This invention for attaining the foregoing aim is characterized in that a bobbin is fabricated by blow molding method of a synthetic plastic.

Specifically stated, a cylindrical wall of the bobbin formed of a synthetic plastic cylindrical body comprises relatively thin-gage zones and relatively thick-gage zones both extending circumferentially and arranged alternately in the axial direction of the bobbin, and constitutes, along the axial contour line, indentations consisting of projecting portions and recessed portions, with the thin-gage zones forming the projecting portions.

The relatively thick-gage zones extending peripherally are defined with a plurality of passage holes for liquid flow at suitable intervals in the peripheral direction.

Further, the bobbin, when axially pressed, is compressible axially in the state that the thin-gage zones protrude outwardly in a U-bend form.

It is effective to further provide the relatively thick-gage zones with stiffening elements such as ribs extending axially in order to encourage further outward protrusion of the thin-gage zones upon compression.

According to the present bobbin thus constructed, when, in yarn treatment, yarn is wound up on the outer periphery of the bobbin and the bobbin and yarn is compressed, the projecting portions in the thin-gage zones are bent in a U-form to protrude outwardly as shown in FIG. 1(*c*), two-dot-dash lines, and the inner yarn layers are supported by the protrusions and contracted axially without biting into the bobbin, thereby to absorb and release the tension of the yarn wound up. Moreover, the passage holes for liquid flow are located between the outwardly projecting portions and permit a treatent liquid which rises and falls through the bobbin to circulate and flow whereby the overall yarn layers can be treated homogeneously and satisfactorily.

DESCRIPTION OF THE PREFERRED EMBODIMENTS

Examples of this invention will be described below with reference to the accompanying drawings.

Figure 1A:
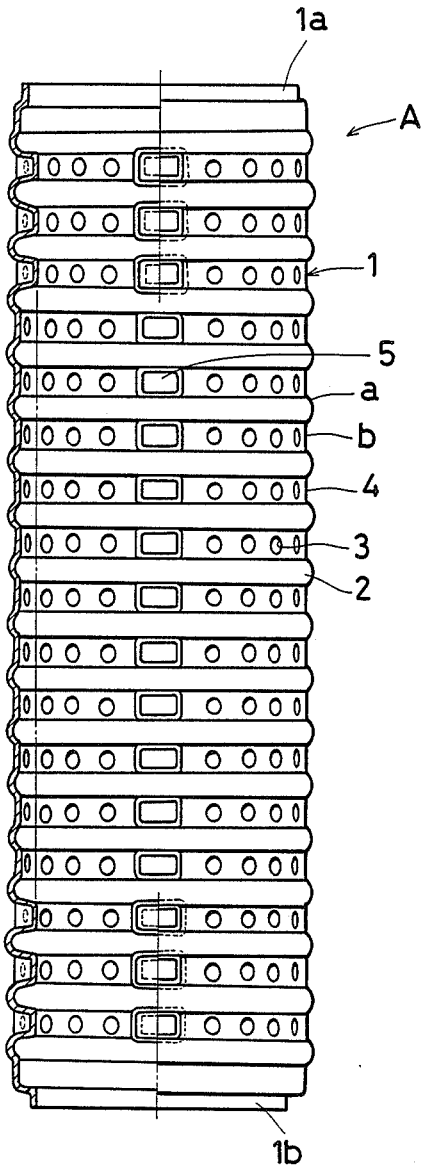
FIG. 1 is an illustration of one example of a press bobbin according to this invention, wherein FIG. 1(*a*) is an elevational view with a part shown in cross-section, FIG. 1(*b*) is a bottom view, and FIG. 1(*c*) an illustration showing a compressed state.
Figure 1B:
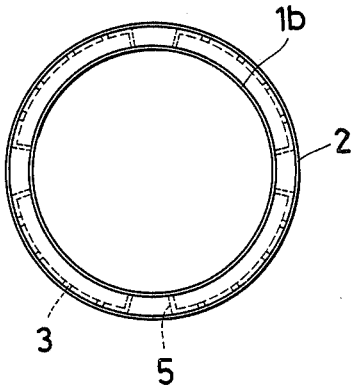
Figure 1C:
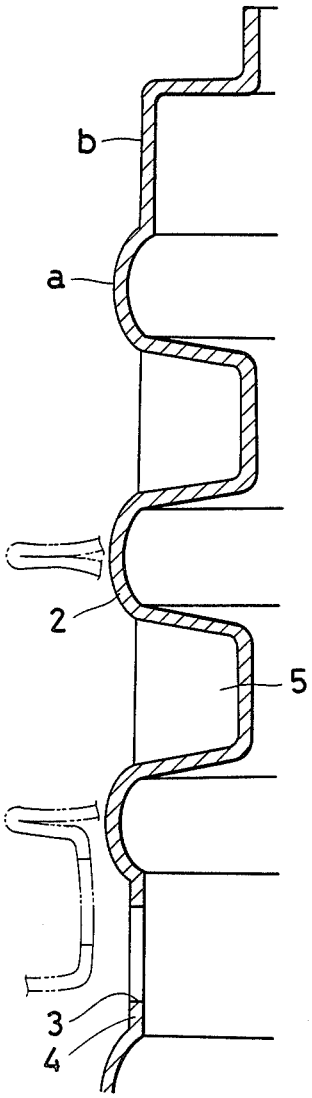

In FIG. 1, the mark A designates the entirety of a bobbin and the reference numeral 1 is a cylindrical wall of a cylindrical element constituting the main part of the bobbin. The cylindrical wall 1 is formed with recessed or indented portions 4 and projecting portions 2 which are arranged alternately along the axial direction of the bobbin, and the recessed portions 4 are defined with passage holes 3 for liquid flow at suitable intervals in the circumferential direction.

The cylindrical wall 1 is fabricated by blow molding of a synthetic plastic so that the recessed portions 4 and projecting portions 2 form annular zones extending circumferentially and the projecting portions 2 in the raised zones have a slightly smaller thickness than the recessed portions 4 in the offset zones. For example, the flat area of the zones including the recessed portions 4 has a thickness of 0.6 mm whereas the zones including the projecting portions 2 have a thickness on the order of 0.4 mm.

Each of the projecting portions 2 is radiused as shown in FIG. 1(*a*) so as to be necessarily bendable when the bobbin is compressed in the axial direction. Each recessed portion 4 is flattened (*b*) so as to not bend upon compression, and if necessary, stiffening members such as stiffening ribs 5 are further provided.

In FIG. 1, the stiffening ribs 5 are illustrated to be arranged at four positions in the axial direction, but the number of the position is not limited to 4, but may be chosen appropriately and it is not always essential to provide ribs.

The bobbin thus constructed is, when axial compression is applied, axially compressible in such a manner that the projecting, thin-gage portions 2 protrude outwardly and the recessed portions 4 which are adapted to be not susceptible to bending are curved only slightly, as shown in FIG. 1(*c*). As a consequence, liquid treatment can be performed in the state that yarn tension is relaxed, without the liquid being prevented from passing.

The deformation caused upon compression may be regulated also in terms of the size and number of the passage holes.

It is advantgeous to construct each bobbin so that upper edge (1*a*) and lower edge (1*b*) thereof can be fitted in other bobbins, since this will permit to mount bobbins in series one upon another.

FIG. 2 to FIG. 5 show another modified examples of a press bobbin according to this invention wherein each bobbin is fabricated by blow molding method.

Figure 2A:
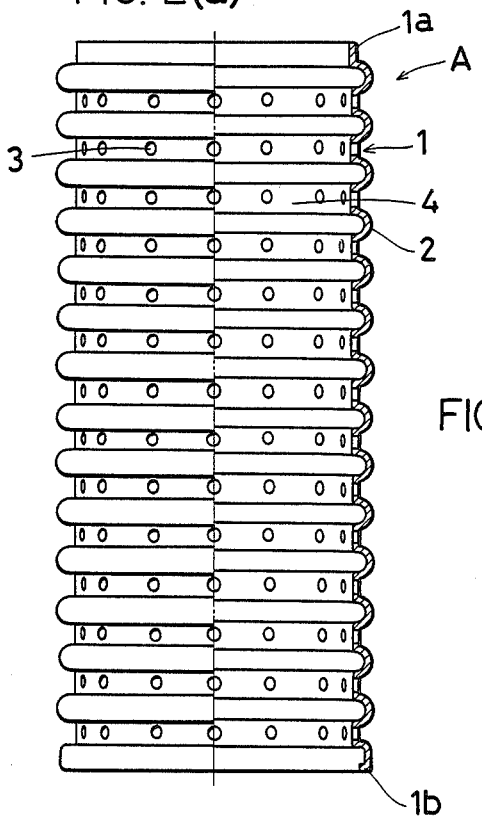
FIG. 2, FIG. 3, FIG. 4 and FIG. 5 are each a view showing another example of press bobbin according to this invention, wherein FIG. 2(*a*), FIG. 3(*a*), FIG. 4(*a*) and FIG. 5(*a*) are each an elevational view with a part shown in cross-section, wherein FIG. 2(*b*), FIG. 3(*b*), FIG. 4(*b*) and FIG. 5(*b*) are each a half bottom view, and wherein FIG. 2(*c*), FIG. 3(*c*), FIG. 4(*c*) and FIG. 5(*c*) are each an illustration showing a compressed state, respectively.
Figure 2C:
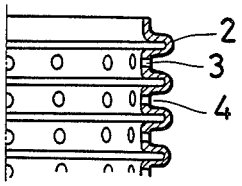
Figure 2B:
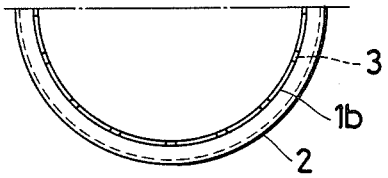

In FIG. 2 showing a most simplified structure, another bobbin is constructed so that a required number of holes 3 for liquid flow are defined dispersedly in the circumferential direction in the zones of relatively thick-gage recessed portions of the cyclindrical wall 1. This bobbin is likewise contracted with the projecting portions 2 protruded outwardly as shown in FIG. 2(*c*).

Figure 3A:
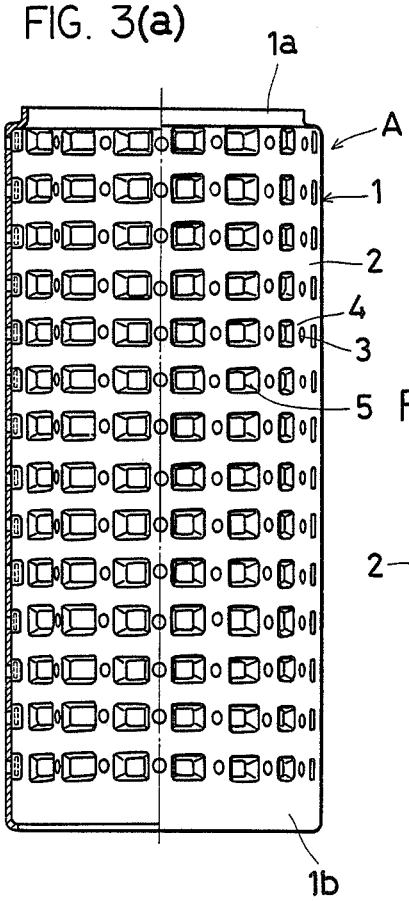
Figure 3C:
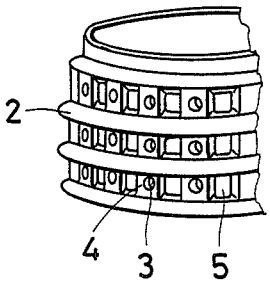
Figure 3B:
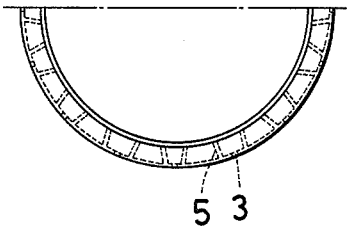

FIG. 3 shows a further bobbin constructed so that outer and inner contours thereof constitute each a hypothetically cylindrical flush face and the zones defined with the holes 3 for flow of liquid are reinforced with stiffening ribs 5 so as to not undergo bending.

The zones extending circumferentially with no hole have a smaller thickness than the zones with the holes 3. When compressed axially, the bobbin assumes the state that the non-hole zones protrude outwardly as shown in FIG. 3(*c*).

Figure 4A:
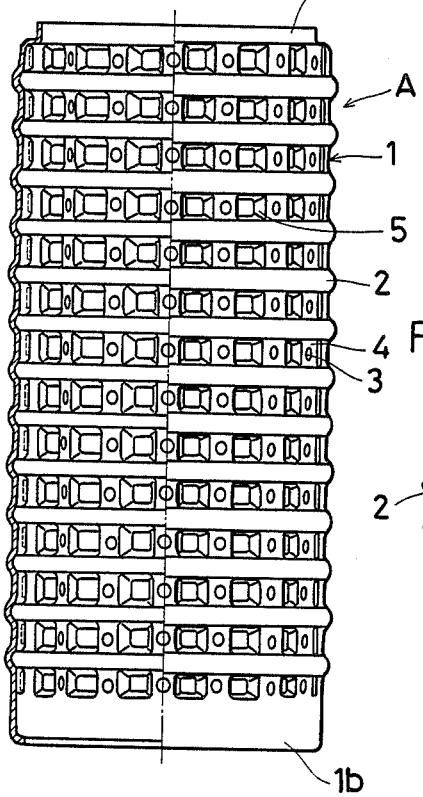
Figure 4C:
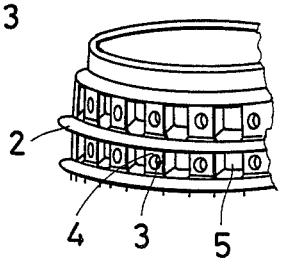
Figure 4B:
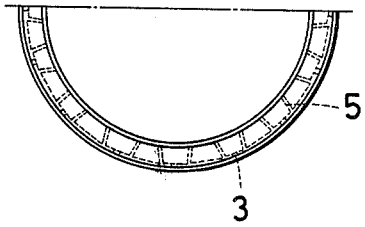

FIG. 4 is a combination of the annular zones with the projecting portions 2 from the structure of FIG. 2 and a reinforcement structure having the stiffening ribs in the recess 4 zones with holes 3 for liquid flow from the structure of FIG. 3. With this bobbin, the one part required to bend is made liable to bend and the other part unfavorable to bend is stiffened so as to not bend.

Figure 5A:
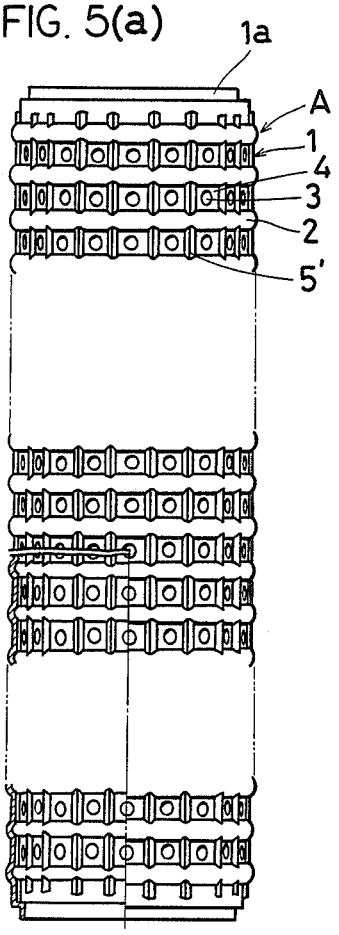
Figure 5B:
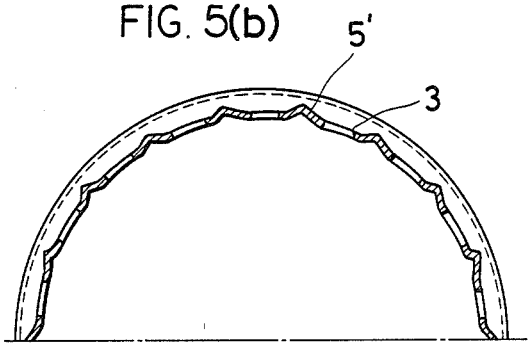
Figure 5C:
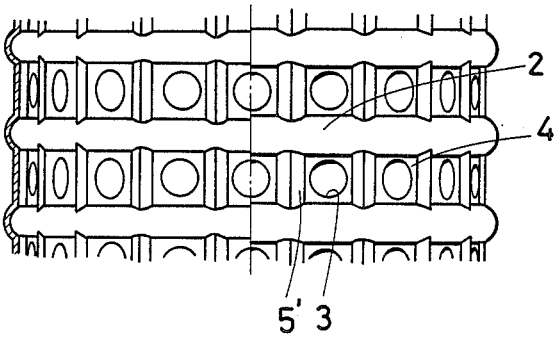
Figure 6A:
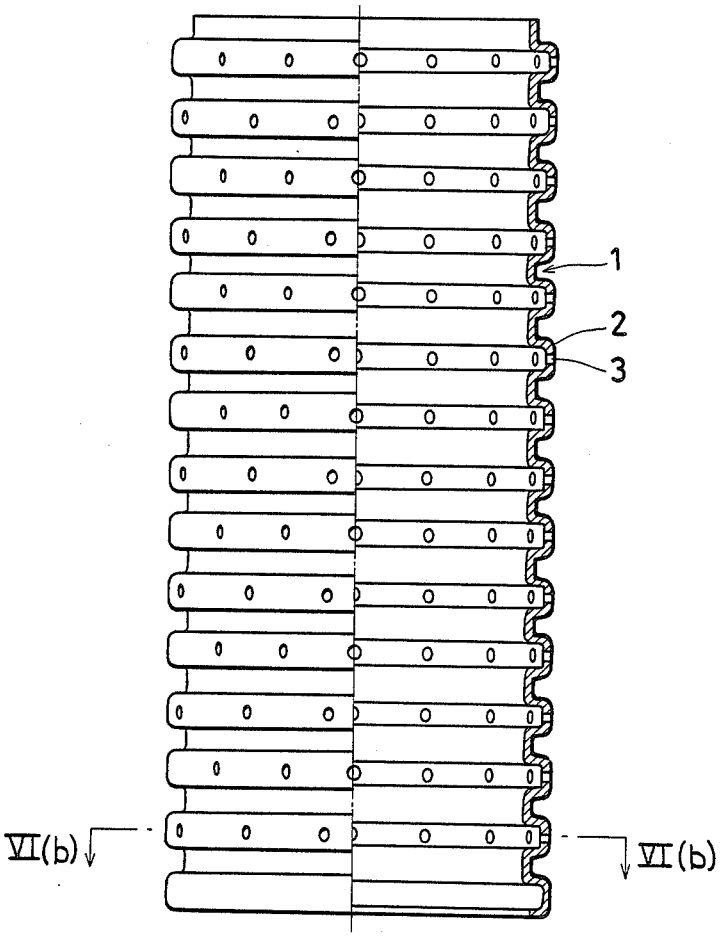
FIG 6(a) PRIOR ART
FIG. 6 is a view showing a prior art example, wherein FIG. 6(*a*) is an elevational view with a part shown in cross-section, and FIG. 6(*b*) is a half sectional view as taken on line VI(*b*)—VI(*b*) of FIG. 6(*a*).
Figure 6B:
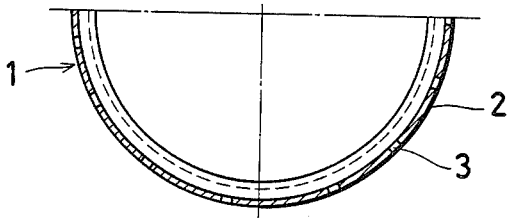
FIG. 6(b) PRIOR ART

FIG. 5 is an improvement over FIG. 4 in the reinforcing structure, wherein V-bent ribs 5' are provided between axially adjacent projecting portions 2 and between the holes 3 for passage of liquid in each recessed portion 1. In this example, too, the projecting portions 2 are, when pressed, facilitated protruding outwardly and consequently, inner yarn layers of the yarn package wound on the outer face of the bobbin can be prevented from biting into it, as is the case with the foregoing embodiments.

This invention is, of course, not limited to those embodiments described above, and various modifications or variations can be made insofar as they don't depart from the foregoing intended object and blow molding method is adopted. Thus, the press bobbin of this invention, when used in a similar manner to conventional press bobbins, permits a more uniform treatment and prevents biting of yarns into it.

To summarize, this invention provides a press bobbin made of a synthetic plastic and constructed of a cylindrical body fabricated by blow molding method which bobbin comprises annular zones having a relatively small thickness and annular zones with a relatively large thickness which both extend circumferentially and are arranged alternately in the axial direction; the relatively thin-gage zones and relatively thick-gage zones constituting an indentation contour in the axial direction, the former being projecting portions and the latter being recessed portions; the zones of the recessed portions being defined with holes for liquid flow; the relatively thin-gage, projecting zones being adapted to be protruded outwardly when pressed axially.

As a consequence, in yarn treatment when the bobbin is pressed axially, it is readily protruded outwardly owing to its thin-gage, projecting zones, and there is no danger that inner yarn of the yarn package will bite into the outer periphery of the bobbin when compressed. Hence, biting of yarn into the bobbin which was a major consideration as a press bobbin is prevented and non-uniform dyeing caused by such biting can also be prevented. The location of the holes in the recessed zones permits uniform and smooth passage of a liquid without obstruction of flowing upon compression, which assists in uniform treatment.

Moreover, the fabrication of bobbins by blow molding method is simple, eliminating the necessity of an intricate metal pattern and curtailing significantly the manufacturing cost of them.

We claim:

1. In a press bobbin for yarn treatment formed of a cylindrical body of a synthetic plastic which is defined, on a cylindrical wall thereof, with a plurality of holes for liquid flow, an improvement in which said cylindrical wall is fabricated by blow molding of the synthetic plastic and comprises a plurality of relatively thin-gage zones and a plurality of relatively thick-gage zones both of which extend circumferentially and are alternatively arranged in the axial direction of the bobbin, said cylindrical wall defines, along the axial direction, an indentation configuration wherein said relatively thin-gage zones and said thick-gage zones correspond to projecting portions and recessed portions, respectively, said thick-gage zones are defined with a plurality of holes for passage of liquid, said thin-gage zones are, when pressed axially, capable of bending in a U-form to protrude outwardly, whereby the bobbin is axially compressible.

2. A press bobbin for yarn treatment as claimed in claim 1, wherein said relatively thick-gage zones extending circumferentially are provided with a plurality of stiffening members extending along the axial direction which members serve to suppress compression of the bobbin.

3. A press bobbin as claimed in claim 1, wherein said relatively thin-gage zones are radiused and said relatively thick-gage zones are flat-faced in respective outer configurations.

* * * * *